US008506121B2

(12) United States Patent
Van Laanen et al.

(10) Patent No.: US 8,506,121 B2
(45) Date of Patent: Aug. 13, 2013

(54) FLOW-THROUGH LED LIGHTING SYSTEM

(75) Inventors: Peter Van Laanen, Boulder, CO (US); Jeff Bisberg, Boulder, CO (US)

(73) Assignee: Albeo Technologies, Inc., Boulder, CO (US)

( * ) Notice: Subject to any disclaimer, the term of this patent is extended or adjusted under 35 U.S.C. 154(b) by 502 days.

(21) Appl. No.: 11/959,335

(22) Filed: Dec. 18, 2007

(65) Prior Publication Data

US 2008/0158878 A1 Jul. 3, 2008

Related U.S. Application Data

(60) Provisional application No. 60/870,607, filed on Dec. 18, 2006, provisional application No. 60/870,608, filed on Dec. 18, 2006, provisional application No. 60/984,075, filed on Oct. 31, 2007.

(51) Int. Cl.
*F21S 4/00* (2006.01)

(52) U.S. Cl.
USPC ..... 362/249.03; 362/294; 362/311.02; 362/373

(58) Field of Classification Search
USPC ..... 362/249.03, 294, 311.02, 373
See application file for complete search history.

(56) References Cited

U.S. PATENT DOCUMENTS

| | | | | |
|---|---|---|---|---|
| 5,082,422 | A * | 1/1992 | Wang | 416/5 |
| 5,136,483 | A | 8/1992 | Schoniger et al. | |
| 5,241,360 | A | 8/1993 | Key et al. | |
| 5,561,346 | A | 10/1996 | Byrne | |
| 5,655,830 | A | 8/1997 | Ruskouski | |
| 6,224,216 | B1 | 5/2001 | Parker et al. | |
| 6,354,714 | B1 | 3/2002 | Rhodes | |
| 6,499,859 | B2 | 12/2002 | Petzl et al. | |
| 6,561,678 | B2 | 5/2003 | Loughrey | |
| 6,590,343 | B2 | 7/2003 | Pederson | |
| 6,609,804 | B2 | 8/2003 | Nolan et al. | |
| 6,678,171 | B1 | 1/2004 | Drews et al. | |
| 6,739,966 | B2 | 5/2004 | DeRegge | |
| 7,033,036 | B2 | 4/2006 | Pederson | |
| 7,080,921 | B2 | 7/2006 | Feldstein | |
| 7,086,765 | B2 | 8/2006 | Wehner | |
| 7,139,617 | B1 | 11/2006 | Morgan et al. | |
| 7,198,387 | B1 | 4/2007 | Gloisten et al. | |
| 7,274,043 | B2 | 9/2007 | Erchak et al. | |
| 7,296,912 | B2 | 11/2007 | Beauchamp | |

(Continued)

FOREIGN PATENT DOCUMENTS

| | | |
|---|---|---|
| WO | WO 2005/024291 | 3/2005 |
| WO | WO 2008007142 A1 | 1/2008 |
| WO | WO 2008/093978 | 8/2008 |

OTHER PUBLICATIONS

Office Action issued in related U.S. Appl. No. 12/431,674 date Sep. 23, 2011, 11 pages.

(Continued)

*Primary Examiner* — Seam Gramling
(74) *Attorney, Agent, or Firm* — Lathrop & Gage LLP

(57) ABSTRACT

A flow-through LED lighting system includes a housing and two or more blades disposed with the housing. At least one blade has a plurality of LEDs mounted therewith, and each blade is separated from an adjacent blade by a venting space. A power supply is configured with the housing, connects with an external power source, and powers the LEDs.

26 Claims, 10 Drawing Sheets

(56) References Cited

U.S. PATENT DOCUMENTS

| | | | | |
|---|---|---|---|---|
| 7,311,423 | B2 * | 12/2007 | Frecska et al. | 362/372 |
| 7,344,284 | B2 | 3/2008 | Lynam et al. | |
| 7,427,152 | B2 * | 9/2008 | Erion et al. | 362/547 |
| 7,507,001 | B2 * | 3/2009 | Kit | 362/276 |
| 7,614,767 | B2 | 11/2009 | Zulim | |
| 8,042,978 | B2 * | 10/2011 | Lu et al. | 362/373 |
| 2003/0048641 | A1 | 3/2003 | Alexanderson et al. | |
| 2004/0120160 | A1 | 6/2004 | Natsume | |
| 2005/0099810 | A1 * | 5/2005 | Tasson et al. | 362/250 |
| 2005/0254241 | A1 | 11/2005 | Harwood | |
| 2007/0047243 | A1 | 3/2007 | Hacker et al. | |
| 2007/0147046 | A1 | 6/2007 | Arik et al. | |
| 2007/0247851 | A1 | 10/2007 | Villard | |
| 2008/0002410 | A1 * | 1/2008 | Burton et al. | 362/294 |
| 2008/0137325 | A1 | 6/2008 | Pastore | |
| 2008/0137333 | A1 | 6/2008 | Tamaoki et al. | |
| 2008/0170380 | A1 | 7/2008 | Pastore | |
| 2008/0192458 | A1 | 8/2008 | Li | |
| 2008/0205054 | A1 | 8/2008 | Ho | |
| 2008/0205060 | A1 | 8/2008 | Chien | |
| 2008/0211427 | A1 | 9/2008 | Budde et al. | |
| 2008/0213094 | A1 | 9/2008 | Okimura | |

OTHER PUBLICATIONS

Response to Office Action issued in related U.S. Appl. No. 12/431,674 date Nov. 1, 2011, 8 pages.

Office Action issued in related U.S. Appl. No. 12/431,674 dated Feb. 8, 2012, 9 pages.

Response to Office Action issued in related U.S. Appl. No. 12/431,674 dated May 8, 2012, 18 pages.

* cited by examiner

FLOW-THROUGH LED LIGHTING SYSTEM

RELATED APPLICATIONS

This application claims priority of U.S. Provisional Patent Application Ser. Nos. 60/870,607 and 60/870,608, both filed Dec. 18, 2006, and to U.S. Provisional Patent Application Ser. No. 60/984,075, filed Oct. 31, 2007. Each of the aforementioned applications is incorporated herein by reference.

BACKGROUND

Light-emitting diode ("LED") based lighting systems continue to increase in popularity, for a number of reasons. Compared to incandescent lighting (based on filament heating), LED lighting systems are much more efficient at conversion of input power to light energy. They are likewise more robust than either incandescent or fluorescent lighting because they do not require filaments, which are prone to breakage. Compared to fluorescent lighting (based on absorption and reemission of photons generated by a plasma), LED lighting systems have longer lifetimes, operate without noticeable flickering and humming, are adaptable to mobile and battery powered applications and do not require high voltage electronics. Additionally, LED systems are environmentally friendly in that, contrary to fluorescent lighting systems, they do not utilize mercury gas to produce light.

SUMMARY

In one embodiment, a flow-through LED lighting system includes a housing and two or more blades disposed with the housing. At least one blade has a plurality of LEDs mounted therewith, and each blade is separated from an adjacent blade by a venting space. A power supply is configured with the housing, connects with an external power source, and powers the LEDs.

In one embodiment, an LED lighting element may be used in a fluorescent lighting fixture, and includes a first end cap formed as a printed circuit board for connecting with and obtaining physical support from a first socket of the fluorescent lighting fixture. A second end cap is formed as a printed circuit board and connects with, and obtains physical support from, a second socket of the fluorescent lighting fixture. A blade supports one or more LEDs between the first and second end caps. A power converter located in one or both of the first and second end caps converts power from the fluorescent light socket into power for operating the LEDs.

In another embodiment, a flow-through LED lighting system, includes a housing with a plurality of blades disposed therein. Each blade is proximate to at least one venting space and a plurality of LEDs are configured with the plurality of blades. At least one optical element is included within the system for conditioning the light emitted by the LEDs and at least one sensor senses one of movement, light level, smoke and sound. A waveform analyzer determines a power level based upon an input waveform from an external power source. Control circuitry controls output of the plurality of LEDs based upon input from the at least one sensor and the power level and controls an actuator to rotate at least one of the blades in response to detected movement. A power supply converts power received from the external power source and supplies power to the at least one sensor, the control circuitry, the actuator and the plurality of LEDs. The at least one venting space allows air to flow past the blades to dissipate heat generated by the LEDs.

DETAILED DESCRIPTION OF DRAWINGS

Figure 1:
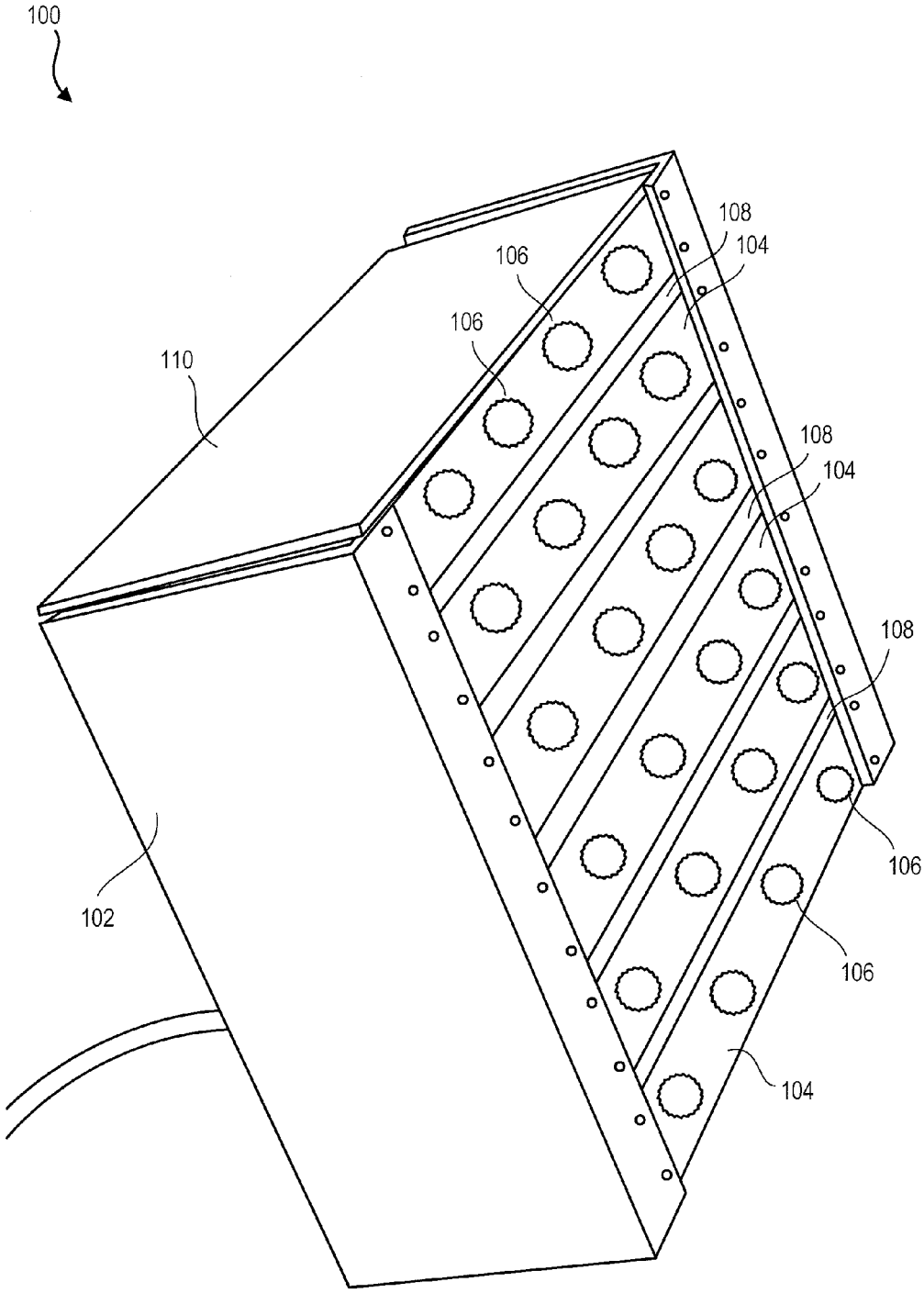
FIG. 1 is a side perspective view of a flow-through LED lighting system, in accordance with an embodiment.
Figure 2:
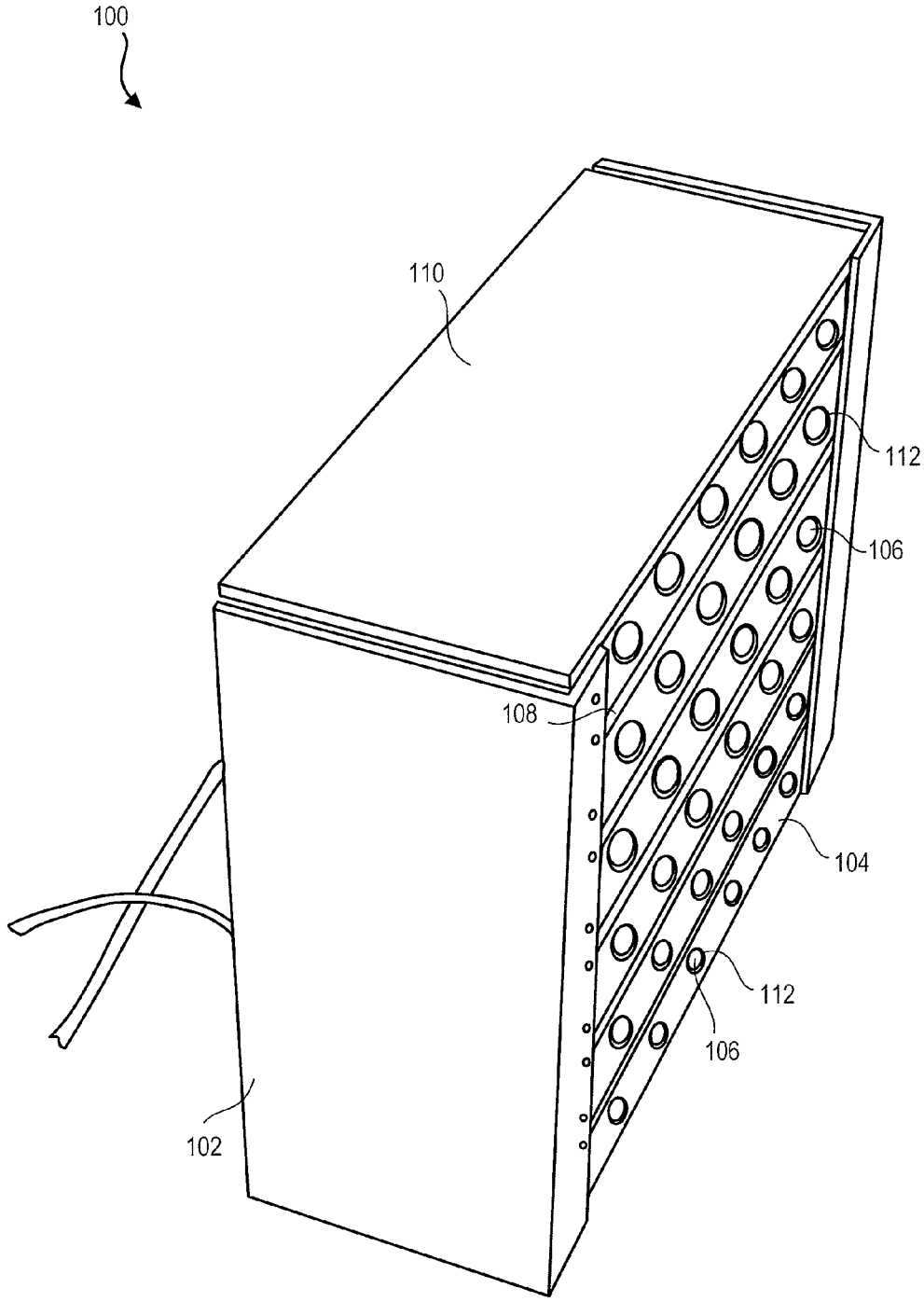
FIG. 2 is a top perspective view of the system of FIG. 1.

As shown in FIGS. 1 and 2, a flow-through LED lighting system 100 has a housing 102 supporting blades 104. Each blade may be substantially 'L' shaped. A plurality of LEDs 106 mount with at least one blade 104; as depicted, each blade 104 supports a plurality of LEDs 106. As used herein, the term "LED" includes light-emitting diodes and other devices based thereon, such as superluminous diodes and laser diodes. Venting spaces 108 separate blades 104 from one another within housing 102. Blades 104 connect with or extend from inner, front sides of housing 102. Housing 104 is for example partially or completely open along a front side; thus, blades 104 and spaces 108 form a vented front face of housing 104. Alternately, blades 104 are supported near the center or back of housing 102, depending upon desired appearance and emission characteristics of system 100. Housing top 110 may be removable, facilitating access to blades 104, LEDs 106 and additional components of system 100 (e.g., as described with respect to FIG. 3).

Figure 3:
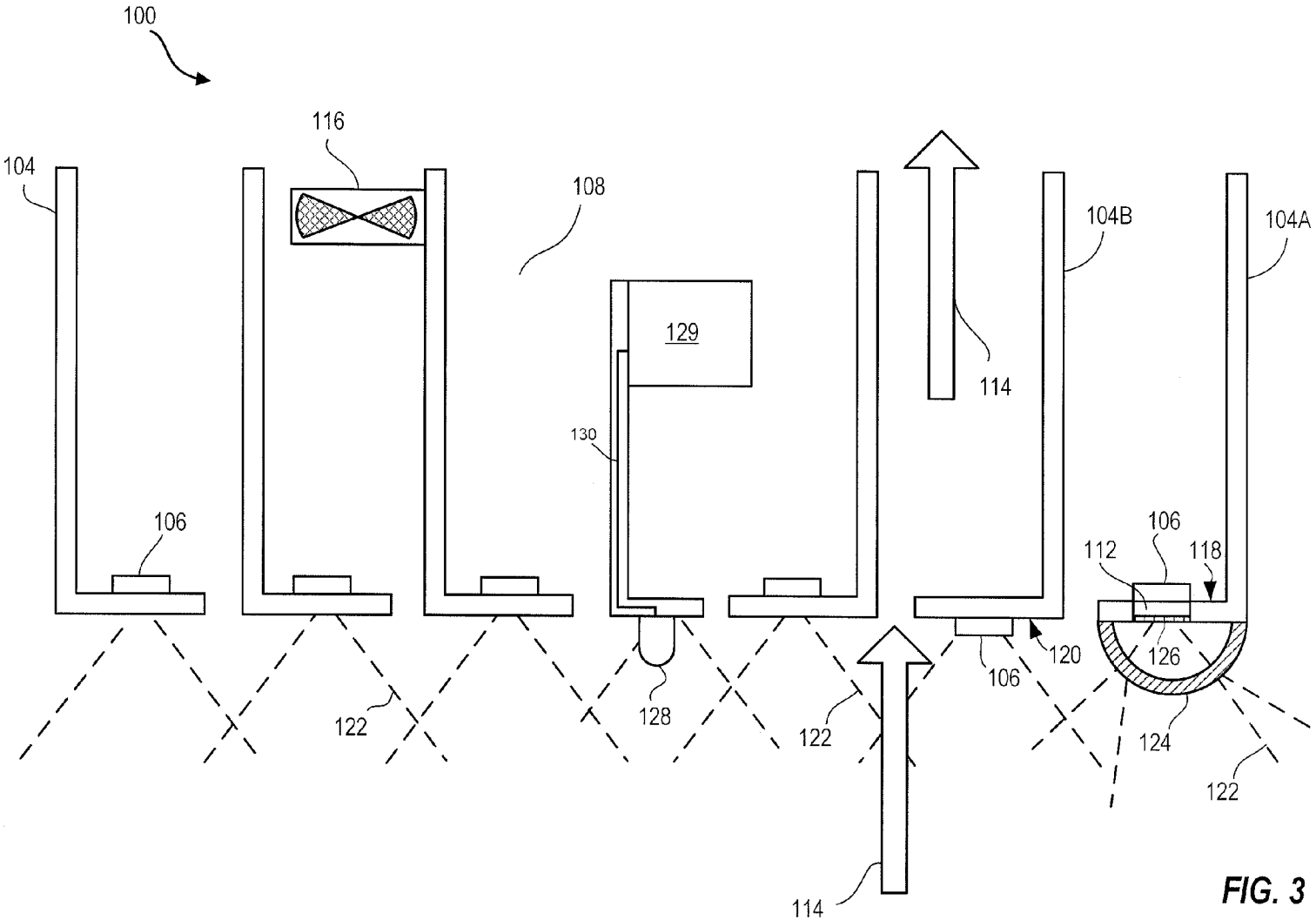
FIG. 3 is a simplified, cross-sectional side view of the system of FIGS. 1 and 2, showing convection flow, LED placement, a sensor and an optical element.

FIG. 3 is a simplified, cross-sectional side view of system 100 of FIGS. 1 and 2, showing convection flow, LED placement, a sensor and an optical element. As shown in FIG. 1, LEDs 106 mount to a front surface 120 of blades 104. In FIG. 2, LEDs 106 mount to a back surface 118 of blades 104, and blades 104 have apertures 112 for transmitting light from LEDs 106 therethrough. Blades 104 are for example extruded metal blades formed with apertures 112. Apertures 112 may be openings through, or glass/plastic windows in blades 104, with each LED 106 centered within one aperture 112 such that light from LEDs 106 emanates from housing 102. LEDs 106 may protrude through or be visible through apertures 112. Blades 104 may be metal and conduct heat away from LEDs 106.

As indicated by air flow arrows 114, FIG. 3, an increase in temperature of LEDs 106, blades 104 and/or housing 102 (e.g., during operation of the LEDs) encourages natural convection of air through venting spaces 108, to dissipate heat to the surrounding environment. Such natural convection significantly reduces operating temperature of system 100. In addition, housing 102 may include a fan 116 for forced cooling. A heat sink (not shown), which may include structures such as thermal fins, and/or a thermoelectric cooler, may replace or augment fan 116 to aid thermal transfer to the environment. LEDs 106 may be positioned on front surface 120 or back surface 118 of blades 104. Blade 104A for example shows an LED 106 mounted to back surface 118 and aligned with aperture 112 such that light 122 from LED 106 shines through aperture 112. Blade 104B has an LED 106 mounted to front surface 120. Returning to blade 104A, an optical element 124, such as a lens, optical diffuser, transmissive or reflective element, is optionally fitted over aperture 112 to modify optical properties of light 122. A transparent or translucent window 126 is for example fitted with aperture 112, to protect LED 106 or to also modify light 122. In one aspect, optical element 124 fits within aperture 112, replacing window 126.

One or more sensors 128 mounted with one or more blades 104 collect input from a range of electromagnetic signals and phenomena. In one example, sensor 128 is a motion sensor that detects motion within a pre-selected range of system 100. Sensor 128 may also be a light-level sensor, a temperature sensor, a smoke detector or an acoustic sensor. Sensor 128 is powered by a power supply 129 via a connection 130, e.g., a wire. Power supply 129 may be a battery, a connection to an external power source or a transformer for an input/output card. Power supply 129 for example powers fan 116, LEDs 106 (connections not shown) and/or a printed circuit board to which the LEDs mount, along with control circuitry in communication with the printed circuit board, as now described with respect to FIG. 4.

Figure 4:
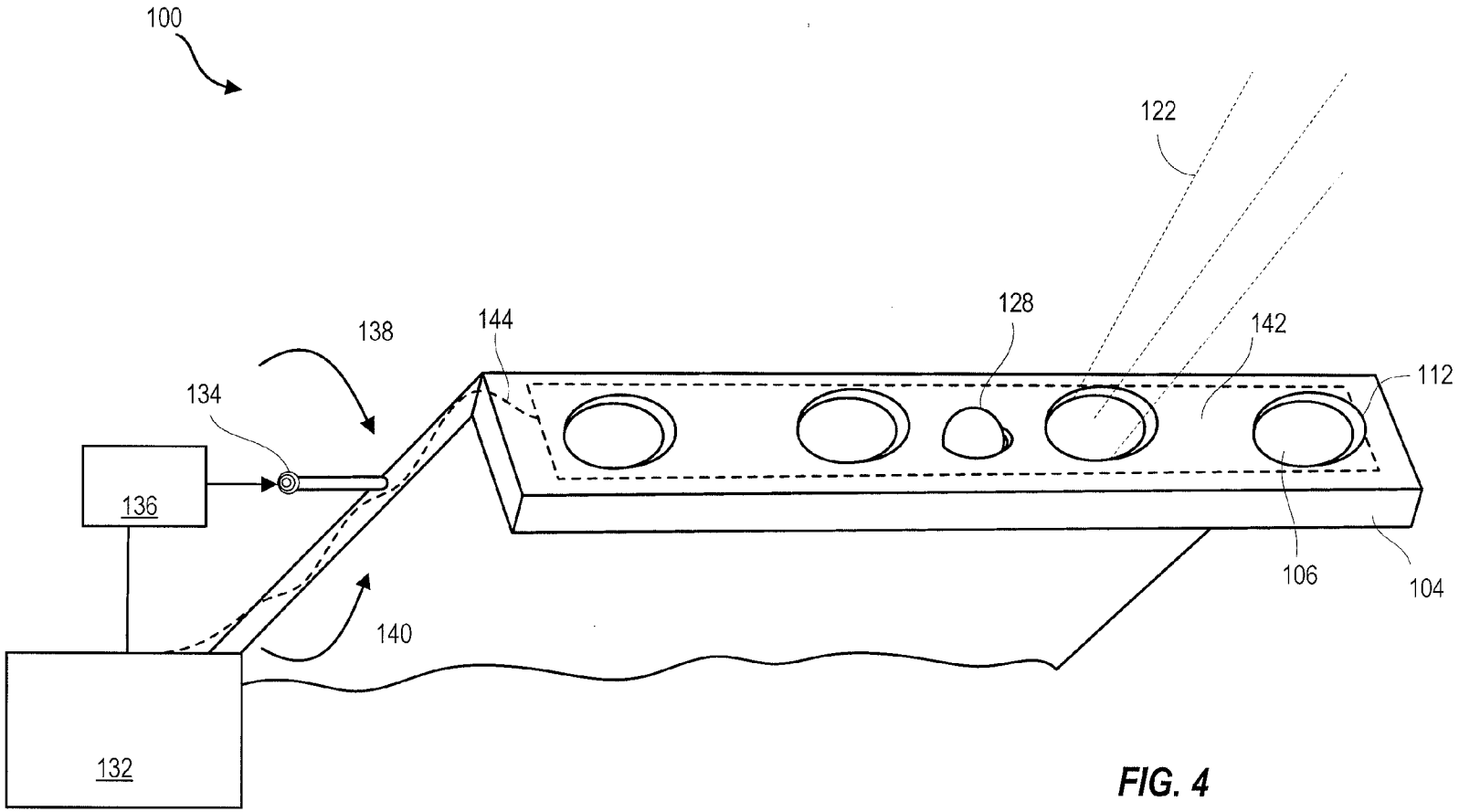
FIG. 4 is a perspective view of an LED mounting blade for a flow-through LED lighting system, with associated controls and inputs, according to an embodiment.

FIG. 4 schematically diagrams a mobile blade 104, in communication with control circuitry 132. Control circuitry 132 may electrically connect with power supply 129, alternately, control circuitry 132 may include one or more of connectors, pins, sockets, wires and other parts for direct connection to external power and logic control. Circuitry 132 for example controls an actuator 136 (e.g., as a motor) for rotating blade 104 clockwise or counter-clockwise about a rotational axis 134, as indicated by rotation arrows 138, 140, respectively. LEDs 106 form part of a printed circuit board assembly ("PCBA") 142, including a PCB (not separately shown) in communication with LEDs 106 (connections not shown). Sensor 128 likewise communicatively connects with PCBA 142. PCBA 142 communicates wirelessly or via a connection 144 (e.g., a wire) with control circuitry 132 to regulate light 122 output by LEDs 106. For example, control circuitry 132 includes one or more of a receiver, a transmitter and microprocessor, for wirelessly communicating with and determining adjustments to make to LEDs 106, e.g., via PCBA 142. Additionally, control circuitry 132 may include its own sensors, in addition to or in place of sensors 128.

In one embodiment, sensor 128 is a motion sensor. Signals received by PCBA 142 from sensor 128 are communicated to control circuitry 132; control circuitry 132 in turn actuates (turns on) or increases light output by LEDs 106 in response to the detected motion, e.g., via return interaction with PCBA 142. For example, PCBA 142 selectively powers LEDs 106 responsive to control circuitry 132. Light output of LEDs 106 may be increased by increasing a number of LEDs 106 that are actuated, or by decreasing or turning off control by a dimming system, described with respect to FIG. 8.

In addition to actuating/increasing light output upon detection of motion, control circuitry 132 for example controls motor 136 to rotate blade 104 clockwise (arrow 138) or counter-clockwise (arrow 140) to direct light 122 toward the detected motion. Sensors 128 may likewise detect a direction of motion. PCBA 142 communicates direction of motion to control circuitry 132, which accordingly controls actuator 136 to rotate blade 104 in the direction of detected motion, to illuminate a predicted path of a moving object, e.g., to provide lighting "on demand" for a passing human. Additionally or optionally, a linear actuator, piezoelectric element or other lateral displacement mechanism (not shown) is employed with blade 104, to shift blade 104 in the direction of detected/predicted motion, under control of circuitry 132 and as a function of signals received from PCBA 142. PCBA 142 likewise interfaces with fan 116 (FIG. 3), directly or via control circuitry 132, for example to actuate fan 116 when sensor 128 is a heat sensor and senses an operating temperature exceeding a pre-selected temperature (e.g., one that would not efficiently be reduced by natural convection).

Sensor 128 may also be a receiver for receiving signals from a transmitter. In one example, the transmitter is disposed with a pen. Sensor 128 detects signals from the transmitter/pen combination and PCBA 142 accordingly directs control circuitry 132 to rotate or shift blades 104 to direct light 122 towards the pen, e.g., to illuminate an area of a desk where a user is writing or drawing.

Control circuitry 132 may connect with an external battery, a wall socket or external circuitry including an electronic security system, a wall switch, a dimmer switch, a home automation system (e.g., smart home system), a smoke alarm, a fire alarm, an electronic garage door opener, a climate control system, an elevator control system, a motion sensor, a biometric sensor, an acoustic sensor, a light-level sensor or other power or control circuitry. System 100 may therefore be integrated with existing building intelligence and power. System 100 for example responds to input from external logic to control light actuation, output, direction and movement (e.g., by controlling rotation and/or shift of blades 104). In one embodiment, system 100 connects via control circuitry 132 with a bus of a smart home system, such that other devices of the smart home system may govern operation of system 100. For example, system 100 may be illuminated when an interconnected alarm clock goes off, to aid in waking a sleeping person. Alternately, sensor 128 is an acoustic sensor that signals PCBA 142 of the alarm; PCBA 142 in turn signals control circuitry to turn on LEDs 106. An acoustic sensor 128 may also be programmed to signal PCBA 142 responsive to one or more voices or voice commands, such that system 100 may be voice-controlled.

Figure 5:
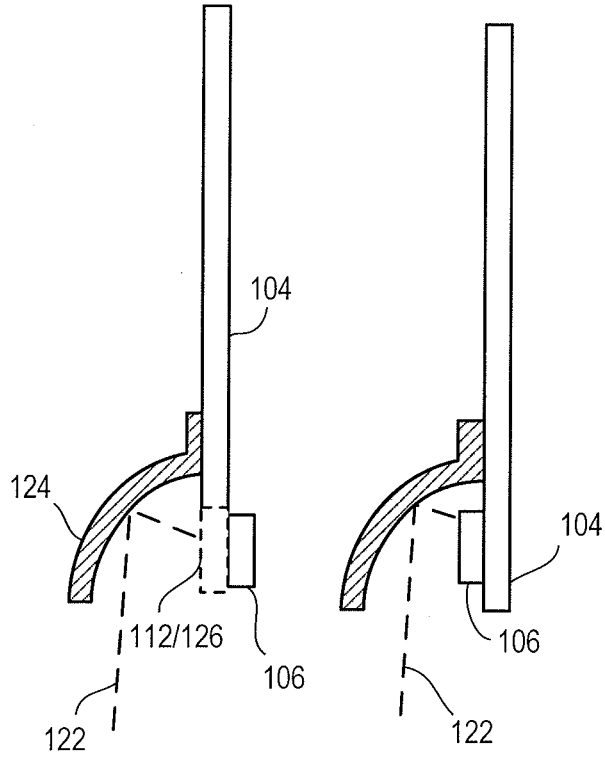
FIG. 5 is a cross-sectional view through exemplary LED mounting blades of the flow-through LED lighting system of FIG. 1.

Light 122 output may be generally perpendicular to blade 104, as shown in FIG. 4. As shown in FIG. 5, light 122 may also be output in a direction generally parallel to blade 104, for example by use of a reflective optical element 124. Each blade is substantially flat with one or more LEDs mounted on one side and emitting light substantially perpendicular to the plane of the blade and one or more reflective optical elements 124 are used to reflect the light to become substantially parallel to the plane of the blade. Optical elements 124 may also be used to achieve diffuse or transmissive scattering of light 122, or to effect other optical transforms. Surface texture on the inside of the optical element may include Fresnel optics, scattering, and reflective components. The element may be interchangeable to provide a selection of potential optical effects. The position and alignment of the optical element may be connected to an actuator and to a control device that receives remote input to provide a real time change in the optical properties or alignment of LEDs 106.

Figure 6:
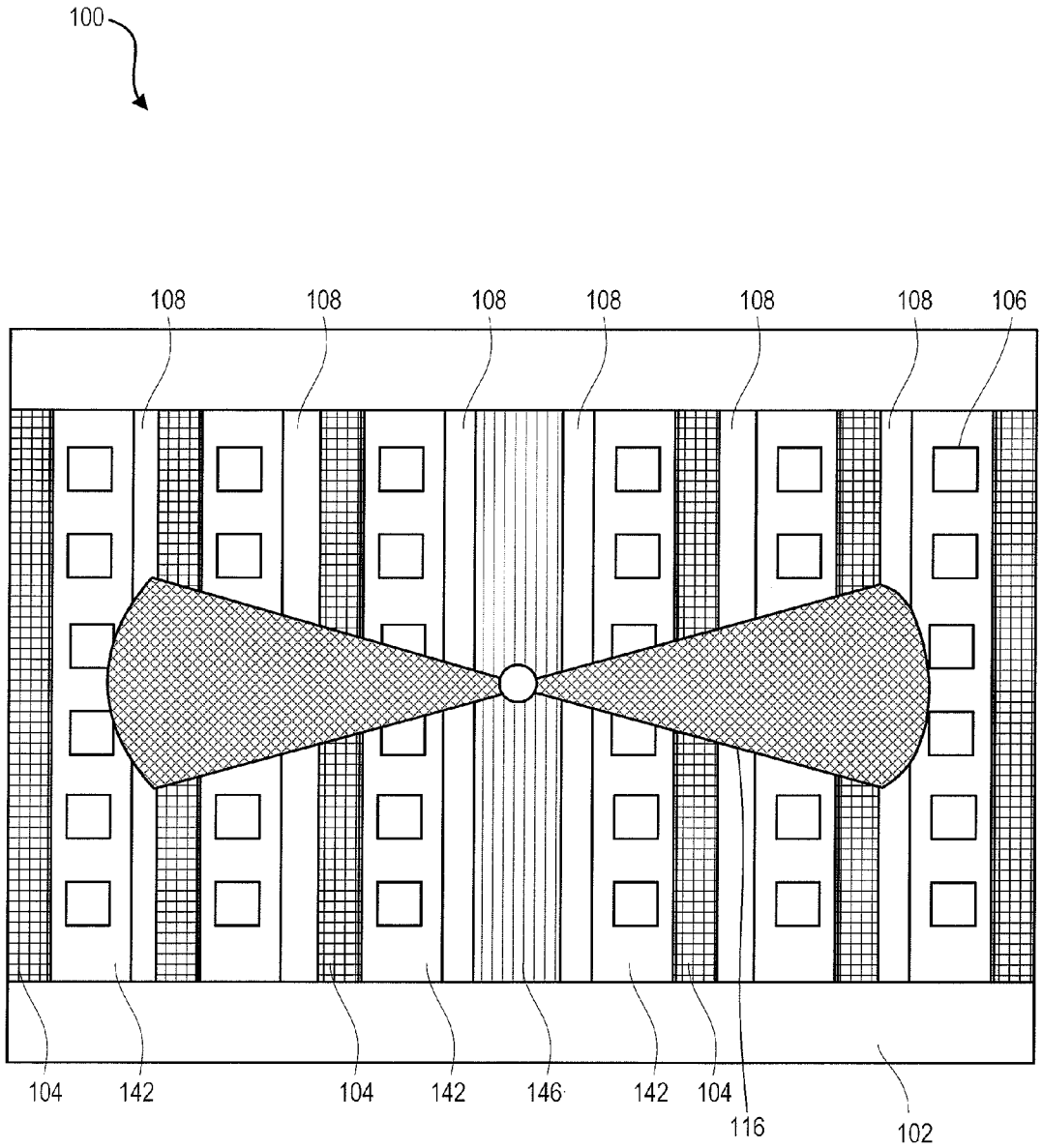
FIG. 6 is a top or rear view of a flow-through LED lighting system, in accordance with an embodiment.
Figure 7:
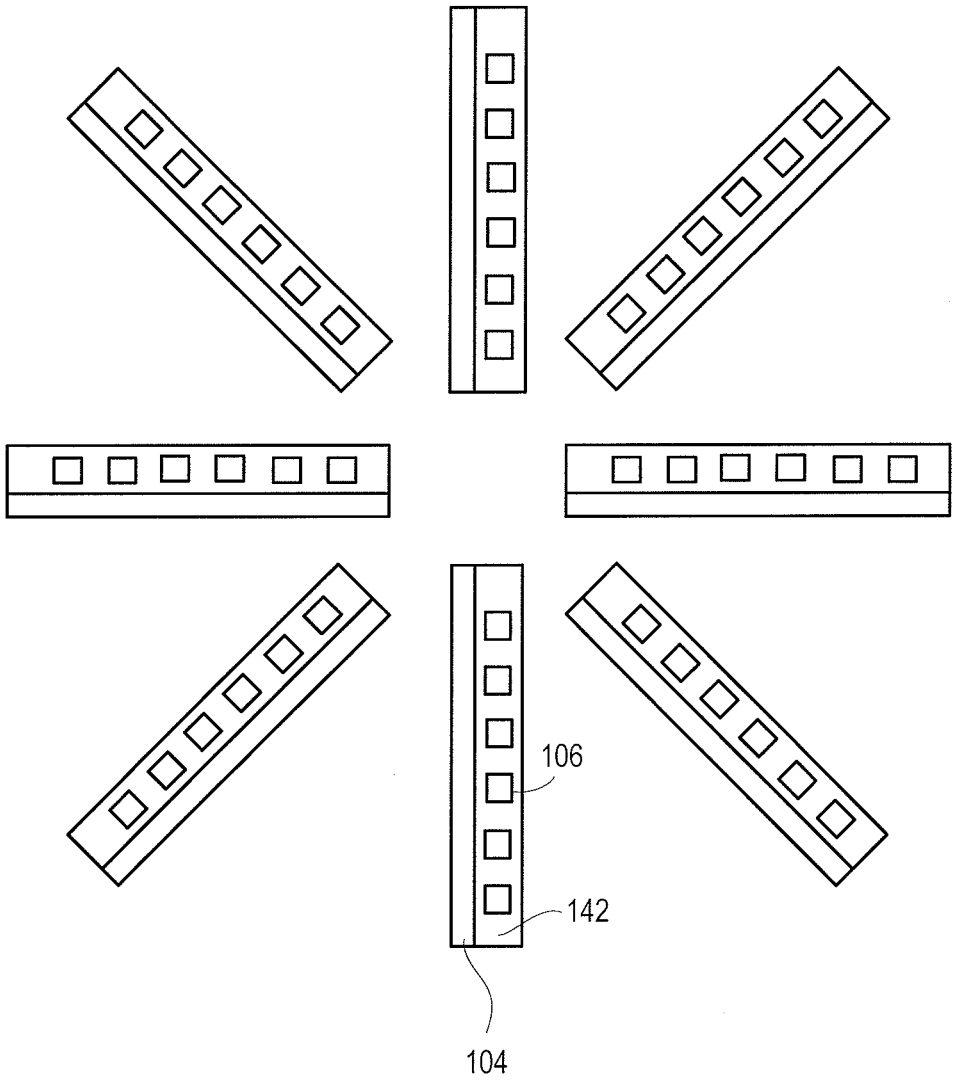
FIG. 7 is a bottom view of an exemplary blade arrangement in a flow-through LED lighting system, according to an embodiment.

FIG. 6 is a top or rear view of system 100, depending upon orientation of the system. Where system 100 is designed with LEDs 106 facing generally downward, e.g., when system 100 mounts with or is suspended from a ceiling, FIG. 6 presents a top view. Where system 100 mounts with a vertical surface, e.g., a wall or a table top, FIG. 6 may be considered a rear view. Fan 116 for example mounts on an inner support 146, shown disposed between blade 104/PCBA 142 units, whose orientation reverses from one side of support 146 to the other side. Blades 104 need not be arranged in lines, but may take on any orientation, such as the circular configuration shown in FIG. 7. Likewise, blades 104 may be staggered, occupying different horizontal or vertical planes. Size and shape of venting spaces 108 between blades 104 may be varied to alter light intensity and thermal performance of system 100. Blades 104 may also be configured with one or more thermal (e.g., fan 116), mechanical (e.g., actuator 136) or optical (e.g., optical elements 124) features. Passive and/or active optical components are integrated into the flow-through lighting system. These optical components can be either integrated directly into the system or attached or suspended in proximity to the lighting system. The components may be reflective and/or refractive and may include scattering or diffusing functionalities. The optical cavity (e.g., optical cavity 1006, FIG. 10) may be "folded" to reduce the size and provide greater spreading of the light rays over a shorter distance.

A power conversion unit may mount with system 100/200 where appropriate, for distributing power to blades 104 through a distribution printed circuit board that provides functionality including, but not limited to, surge voltage, polarity and thermal management.

Figure 10:
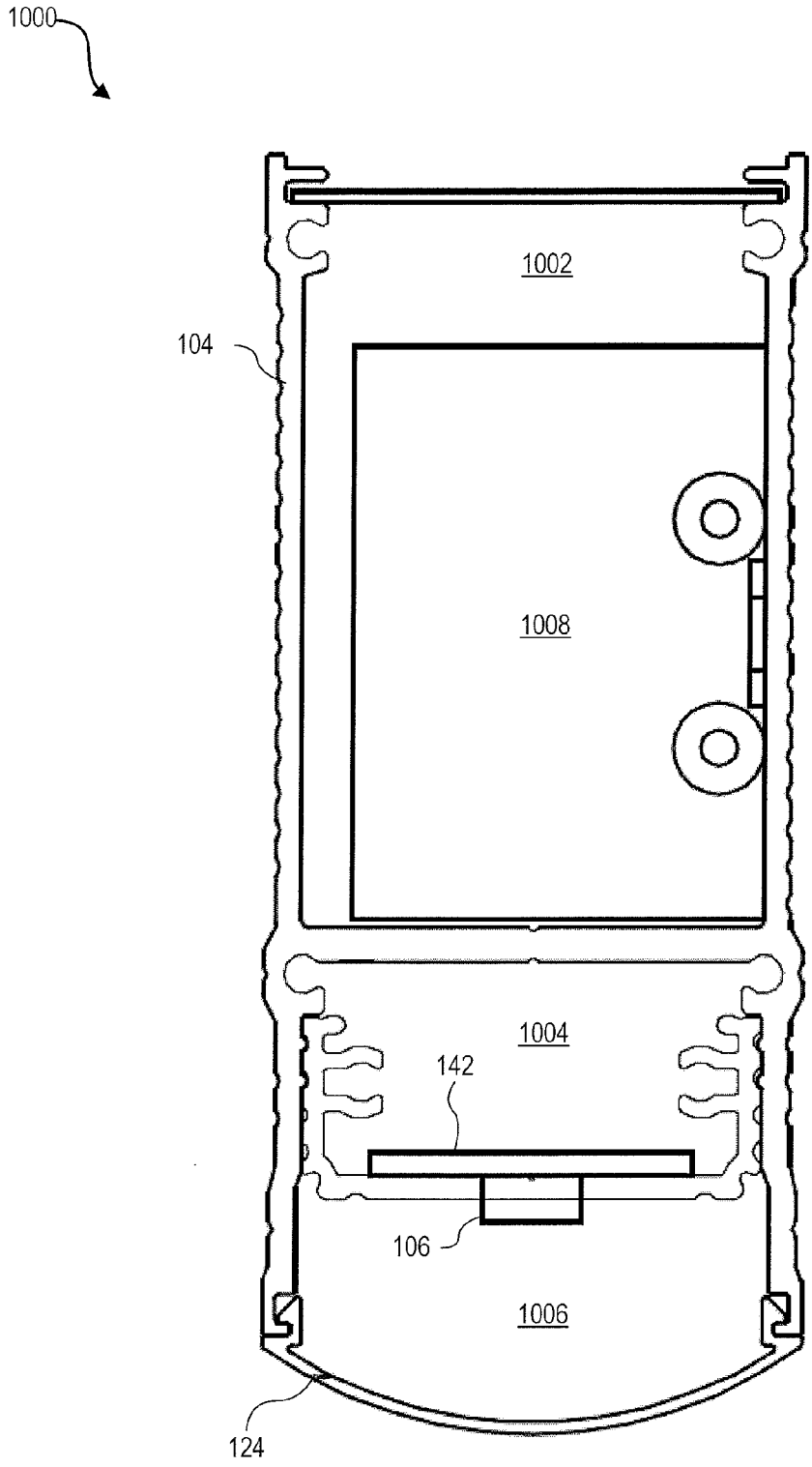
FIG. 10 shows a cross-section through one exemplary blade of the system of FIG. 1, illustrating a compartmental design.

FIG. 10 shows a cross-section 1000 through one exemplary blade 104 of system 100, FIG. 1, illustrating a compartmental design. That is, blade 104 is constructed to have multiple cavities 1002, 1004, 1006. Cavity 1002 may contain high voltage interconnects and components; cavity 1004 contains the low voltage LED assembly; and cavity 1006 represents an optical cavity. Cavities 1002, 1004 and 1006 may have other functionality without departing from the scope hereof. The structure of blade 104 simplifies installation of system 100, and provides a functional space that is protected from the environment and still separated from the LED assemblies. In particular, cavity 1002 is shown containing a power supply 1008, which may represent power supply 129, FIG. 3. Cavity 1002 may also include control circuitry (e.g. control circuitry 132) and/or wireless communication circuitry. Sensors and microprocessors may provide real-time monitoring of the local environment of blade 104 to maximize energy savings, for example by monitoring temperature and integrating into a building control system. Sensor 128 for example represents a light-level sensor configured with system 100 (e.g., at blade 104), which detects when ambient light level falls below one or more pre-set levels, to actuate or brighten output by LEDs 106.

Figure 8:
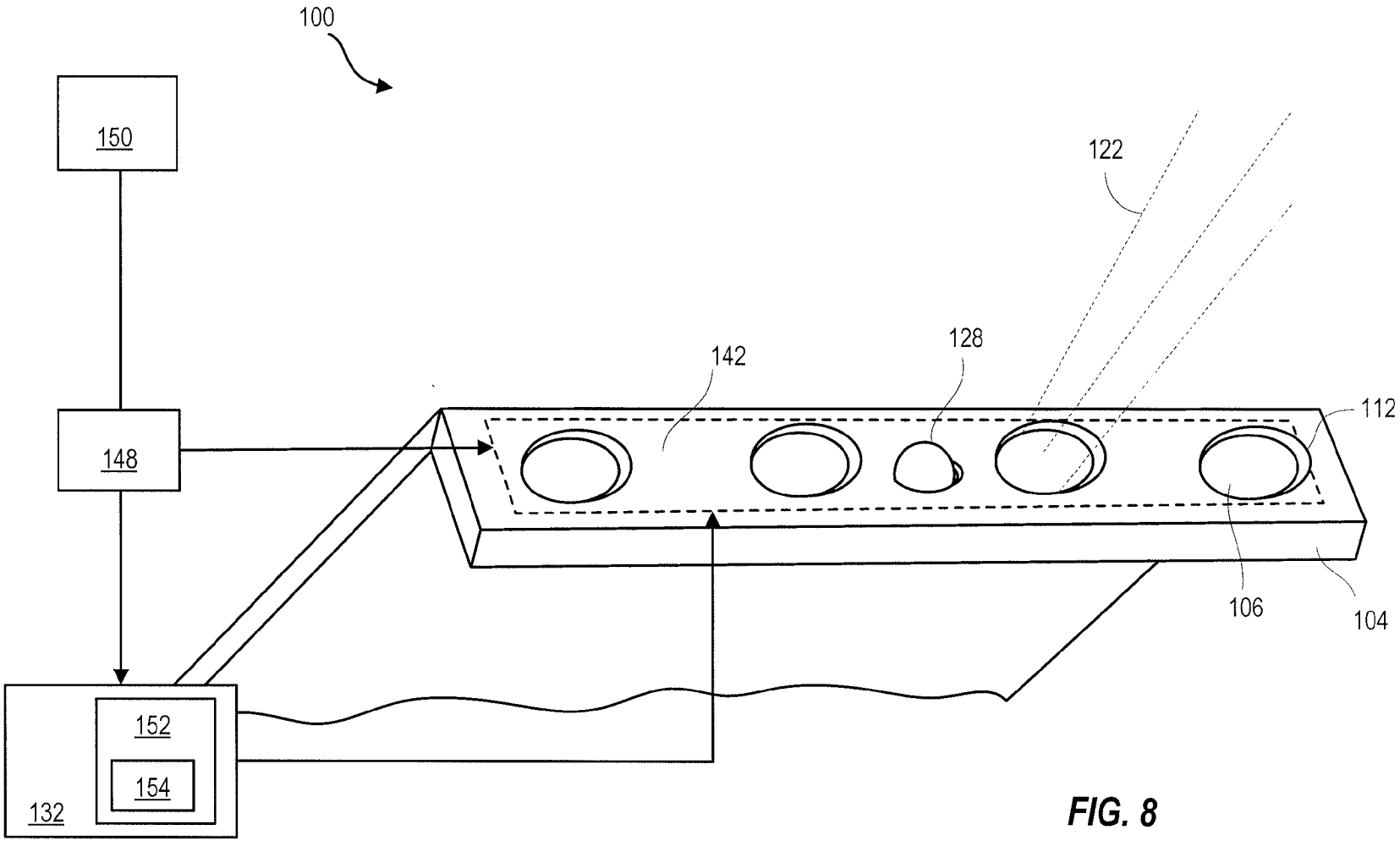
FIG. 8 diagrams control of LED brightness in a flow-through LED lighting system, according to an embodiment.

FIG. 8 diagrams control of LED brightness in the flow-through LED lighting system of FIG. 1. A dimmer mechanism 148 may be employed to dim LEDs 106 of any of FIGS. 1-7. Dimmer mechanism 148 may also be used in reverse, to brighten LEDs 106 as ambient light decreases. Dimmer 148 connects with an external power source 150 and communicates wirelessly or via a wired connection with control circuitry 132 of system 100. Dimmer 148 is for example a wall dimmer. Dimmer 148 signals control circuitry 132 to produce a desired level of light output, for example when a setting is selected by a user. Where dimmer 148 represents a triac based dimmer, as used for dimming control of incandescent lighting, control circuitry 132 includes a microprocessor 152 and/or a waveform analyzer 154 for analyzing an output waveform of dimmer 148 to determine a power measurement, e.g., a "percent on" or "percent off" representative of the power setting of dimmer 148. In other words, the waveform shape produced by dimmer 148 may be used to control brightness of the LEDs. One or more of duty cycle, average and RMS of this waveform are for example converted (e.g., by waveform analyzer 154) into a control signal that ranges from fully on to fully off. Control circuitry 132 signals PCBA 142 to control LEDs 106 to achieve a light level (percent on or percent off) corresponding to the selected setting of dimmer 148. In another embodiment, PCBA 142 includes waveform analyzer 154, such that waveform is analyzed and light level controlled at the printed circuit board assembly.

Figure 9:
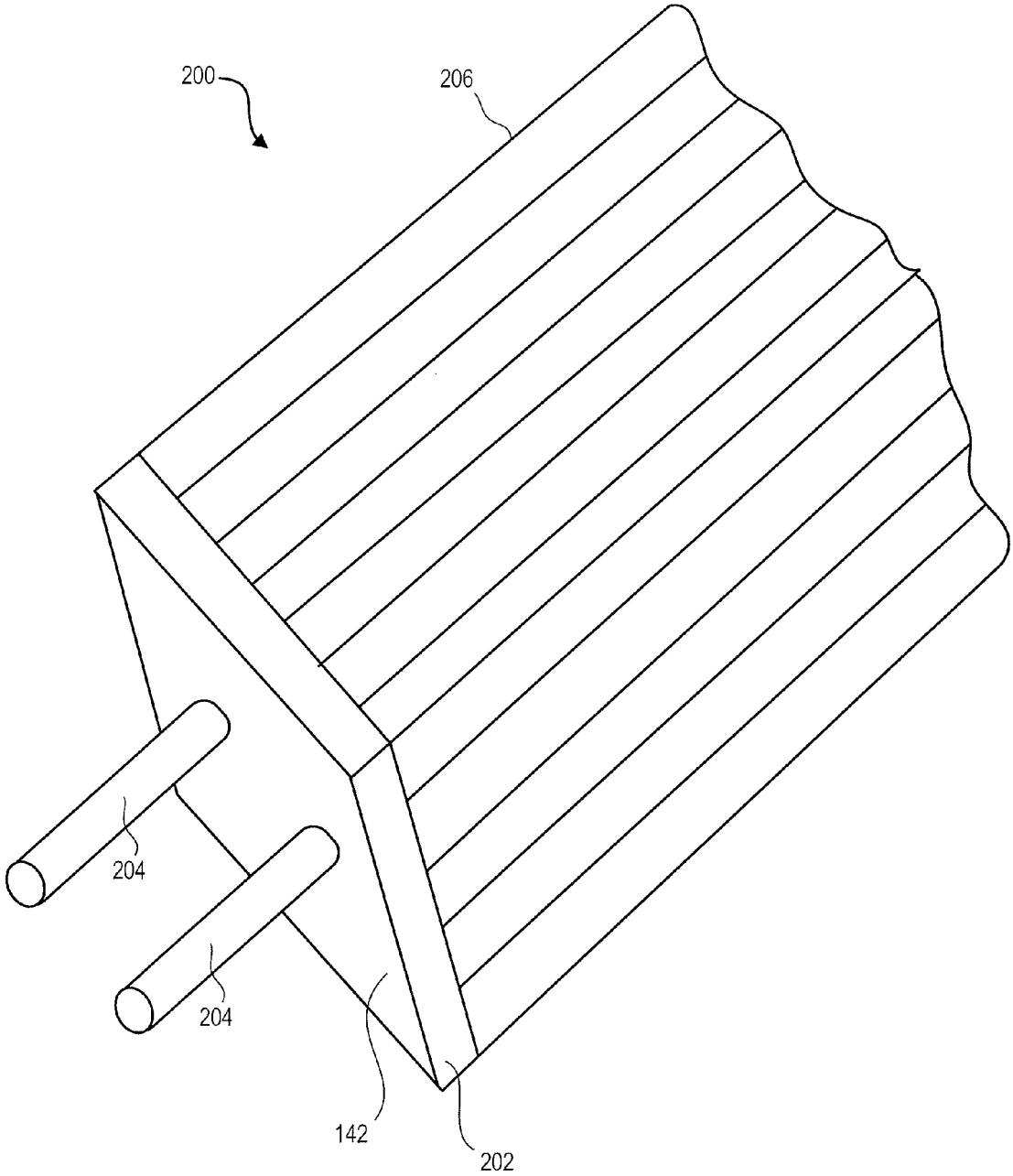
FIG. 9 shows a LED fluorescent replacement system for operation within a traditional fluorescent bulb holder and including a printed circuit board forming an end-cap through which power is routed to the LED lighting elements, according to an embodiment.

FIG. 9 shows a fluorescent replacement system 200 with PCBA 142 forming an end cap 202. PCBA 142 connects system 100 with an existing light fixture, e.g., a fluorescent light fixture having a single pin, bi-pin, medium bi-pin, tombstone, R17d or high output ("HO") interface. In contrast to FIG. 4, for example, where PCBA 142 is disposed with blade 104, PCBA 142 forms or is disposed with end cap 202, in FIG. 9. End cap 202 for example has bi-pin connectors 204 for connecting with an existing bi-pin fluorescent socket. System 200 is similar to system 100, described above, except that power supply 129 may be eliminated where pins 204 provide electrical connection to the existing fluorescent socket. In such case, power is obtained from the power source connected with the fluorescent socket. The fluorescent socket may thereby provide both physical support and an electrical interface for system 200. PCBA 142 communicates with LEDs 106 on blades 104, within a housing 206. Blades 104 are for example oriented parallel to the longitudinal axis of housing 206.

PCBA 142 may also contain circuitry that prevents damage to the system caused by high voltage or high current surges. Circuitry that senses signals that are transmitted on the incoming power lines may be located within PCBA 142.

Changes may be made in the disclosed flow-through LED lighting system without departing from the scope hereof. It should thus be noted that the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall there between.

What is claimed is:

1. A flow-through LED lighting system, comprising:

a housing;

two or more blades disposed between portions of the housing such that the housing substantially surrounds two longitudinal ends of each blade, at least one blade having a plurality of LEDs mounted longitudinally therewith, each blade being separated from an adjacent blade by a venting space, at least one blade comprising a first compartment housing a power supply, a second compartment, separated from the first compartment and housing low voltage circuitry, and a third compartment forming an optical cavity.

2. The system of claim 1, the venting space being rectangular in cross section, such that two of the blades form two opposing sides of the venting space, and the portions of the housing form two other opposing sides of the venting space.

3. The system of claim 1, the LEDs disposed along an outer edge of the second compartment.

4. The system of claim 1, the LEDs disposed along an inner edge of the second compartment, the at least one blade forming an aperture for each of the plurality of LEDs, so that light from each LED transmits through its aperture.

5. The system of claim 1, each venting space facilitating convection of air between the portions of the housing, to dissipate heat produced by the LEDs.

6. The system of claim 5, further comprising a fan for increasing heat dissipation.

7. The system of claim 6, the LEDs and the fan being positioned such that when the LEDs face generally downward, the fan is disposed upwards from the LEDs.

8. The system of claim 1, further comprising control circuitry for controlling output of the LEDs.

9. The system of claim 8, further comprising a sensor for sensing a condition of (a) the LED lighting system or (b) an area proximate the system, the sensor communicating with the control circuitry to control output of at least one of the LEDs as a function of the sensed condition.

10. The system of claim 9, one or more of the sensor, the LEDs and the control circuitry comprising a printed circuit board disposed with the blade.

11. The system of claim 9, further comprising an actuator in communication with the control circuitry, the control circuitry controlling the actuator to adjust one or both of rotation and shift of at least one blade in response to input from the sensor.

12. The system of claim 9, the condition comprising one of (a) temperature of the LED lighting system, (b) motion within the area, (c) light level within the area, (d) smoke within the area, and (e) sound within the area.

13. The system of claim 8, further comprising a waveform analyzer that converts one or more of duty cycle, average and RMS of an input waveform from a dimmer into a control signal, the control circuitry regulating light output of the LEDs based upon the control signal.

14. The system of claim 1, further comprising an optical element for mounting with the at least one blade or the housing, to modify an optical property of light emitted by the LEDs.

15. The system of claim 1, the two or more blades being substantially parallel to one another between the portions of the housing.

16. The system of claim 1, the two or more blades being housed in substantially radial alignment.

17. The system of claim 1, the first, second and third compartments being separate sections among which an enclosed space of the at least one blade is divided, such that in a cross-sectional profile of each blade, when the blade is oriented so that the LEDs emit light downwardly:

the first compartment is adjacent to and atop the second compartment, and is separated from the second compartment by a first structure of the at least one blade; and the second compartment is adjacent to and atop the third compartment, and is separated from the third compartment by a second structure of the at least one blade.

18. The system of claim 17, wherein the at least one blade comprises a metal extrusion, and the first structure comprises metal of the extrusion.

19. The system of claim 18, wherein the second structure comprises one or more of an LED assembly including the LEDs, and metal of the extrusion.

20. The system of claim 1, the power supply comprising one of a battery and a transformer.

21. The system of claim 12, the condition comprising a direction of detected motion within the area, the control circuitry controlling the actuator to rotate the at least one blade in the direction of the detected motion.

22. A flow-through LED lighting system, comprising:

a housing;

a plurality of blades disposed within the housing, each blade being proximate to at least one venting space;

a plurality of LEDs configured with the blades, each of the blades forming an aperture for one of the plurality of LEDs, so that light from each LED emits through its corresponding aperture;

at least one optical element for conditioning the light emitted by the LEDs;

at least one sensor for sensing one of movement, light level, smoke and sound;

a waveform analyzer for determining a power level based upon an input waveform from an external power source;

an actuator for rotating at least one of the blades;

control circuitry for controlling output of the plurality of LEDs based upon input from the at least one sensor and the power level and for controlling the actuator to rotate the at least one blade in response to detected movement;

a power supply for converting power received from the external power source to supply the at least one sensor, the control circuitry, the actuator and the plurality of LEDs;

wherein the at least one venting space allows air to flow past the blades to dissipate heat generated by the LEDs.

23. A flow-through LED lighting system, comprising:

at least two vertical housing portions;

two or more blades disposed between the vertical housing portions such that the housing portions substantially delimit each blade at two opposing ends thereof, each of the blades comprising:

a first blade portion that substantially forms a plane extending vertically between the vertical housing portions, and a second blade portion that substantially forms a plane extending horizontally between the vertical housing portions;

a side edge of the second blade portion being coupled with a bottom edge of the first blade portion such that a cross-section of the blade forms an L shape;

and wherein a plurality of LEDs is mounted with the second blade portion such that light from the LEDs emits downward.

24. The flow-through LED lighting system of claim 23, wherein the LEDs mount on back surfaces of the second blade portions and emit the light through apertures formed in the second blade portions.

25. The flow-through LED lighting system of claim 23, wherein the LEDs mount on front surfaces of the second blade portions.

26. A flow-through LED lighting system, comprising:

a housing; and two or more blades disposed with the housing, each of the blades comprising extruded metal, wherein:

a first cavity of each blade contains a power supply, and is separated by the extruded metal from a second cavity;

the second cavity contains an LED assembly, and LEDs of the LED assembly emit light into a third cavity towards an optical element, the third cavity being bounded at least in part by each of the LED assembly, the extruded metal, and the optical element.

* * * * *